United States Patent [19]

Bender

[11] Patent Number: 4,766,679

[45] Date of Patent: Aug. 30, 1988

[54] MIDSOLE FOR ATHLETIC SHOES

[75] Inventor: Gerhard Bender, Herzogenaurach, Fed. Rep. of Germany

[73] Assignee: PUMA Aktiengesellschaft Rudolf Dassler Sport, Herzogenaurach, Fed. Rep. of Germany

[21] Appl. No.: 90,580

[22] Filed: Aug. 28, 1987

[30] Foreign Application Priority Data

Aug. 28, 1986 [DE] Fed. Rep. of Germany ..... 3629212

[51] Int. Cl.[4] ..... A43B 13/12; A43B 7/14

[52] U.S. Cl. ..... 36/30 R; 36/68

[58] Field of Search ..... 36/25 R, 30 R, 31, 32 R, 36/92, 114, 80

[56] References Cited

U.S. PATENT DOCUMENTS

| | | | |
|---|---|---|---|
| 3,566,486 | 3/1971 | Conway | 36/114 |
| 4,364,188 | 12/1982 | Turner et al. | 36/30 R |
| 4,484,397 | 11/1984 | Curley, Jr. | 36/68 |
| 4,490,928 | 1/1985 | Kawashima | 36/30 R |
| 4,506,462 | 3/1985 | Cavanagh | 36/114 |
| 4,530,173 | 7/1985 | Jesinsky, Jr. | 36/92 |
| 4,547,979 | 10/1985 | Harada et al. | 36/31 |
| 4,551,930 | 11/1985 | Graham et al. | 36/30 R |
| 4,614,046 | 9/1986 | Dassler | 36/30 R |
| 4,667,423 | 5/1987 | Autry et al. | 36/25 R |
| 4,694,591 | 9/1987 | Bamch et al. | 36/31 |

FOREIGN PATENT DOCUMENTS

| | | | |
|---|---|---|---|
| 0168802 | 9/1984 | Japan | 36/25 R |
| 2114869 | 9/1983 | United Kingdom | 36/25 R |

*Primary Examiner*—Steven N. Meyers

*Attorney, Agent, or Firm*—Sixbey, Friedman, Leedom & Ferguson

[57] ABSTRACT

A midsole for athletic shoes, especially for medium and long distance track events, of soft elastic material, which in the heel area has, on its underside, a recess into which is inserted a stabilizing element of a material that is harder than that of the midsole is improved so that harmful supination positions are avoided. This is achieved by the fact that the stabilizing element (9) consists of a U-shaped part (10), covering the entire heel edge area, and a part which closes the U-shaped part at the middle part of the foot in a manner creating a window (13) into which an island of the full thickness of the midsole engages. The stabilizing element (9) also has a strip which extends along the lateral side of the midsole up to at least, approximately, the little toe area of a shoe provided with such a midsole.

19 Claims, 1 Drawing Sheet

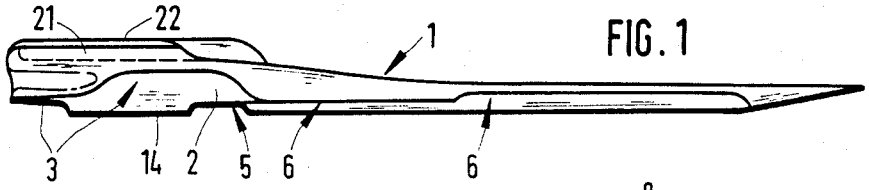
FIG. 1
FIG. 4
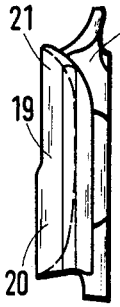
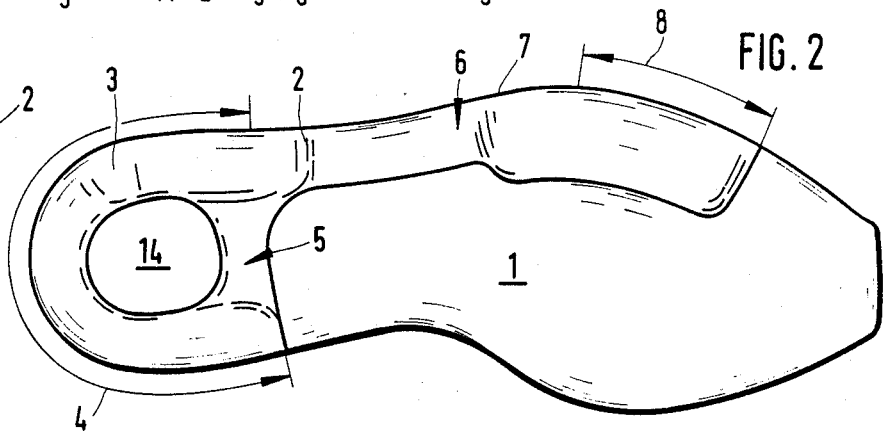
FIG. 2
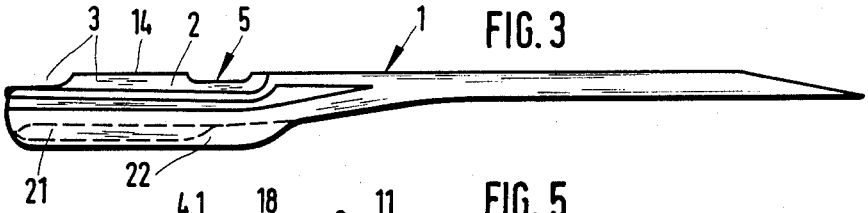
FIG. 3
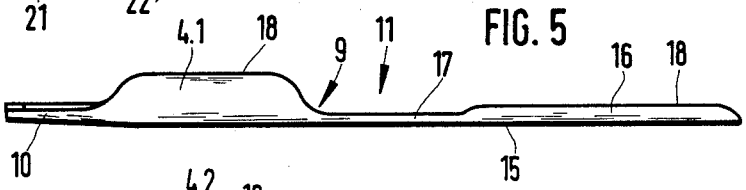
FIG. 5
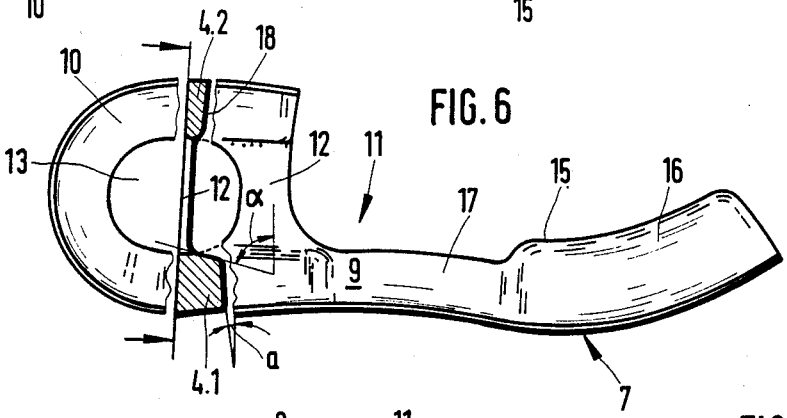
FIG. 6
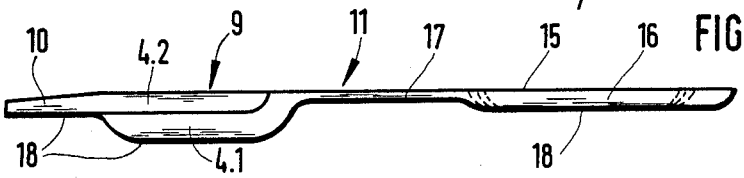
FIG. 7

MIDSOLE FOR ATHLETIC SHOES

BACKGROUND AND SUMMARY OF THE INVENTION

This invention relates to a midsole for athletic shoes, particularly for medium and long distance running, formed of soft elastic material and having a heel recess containing a firmer elastic material.

Such a midsole is known from U.S. Pat. No. 4,614,046. There a stabilizing element is provided in the shape of a C or L extending in the longitudinal direction of the sole, and the open side of this stabilizing element is provided on the outside of the midsole. By this measure, above all, the twisting of the shin by pivoting of the foot inward, known as "overpronation," i.e., a pronation to a harmful extent, can be counteracted.

Additionally, U.S. Pat. No. 4,490,928 discloses a midsole having a body of resilient foam material and a horseshoe-shaped plate of a rigid synthetic plastic that is recessed into the top surface of the midsole at the heel area. The medial side portion of the horseshoe-shaped plate is longer than the lateral side portion, and at least one leg extends downwardly through the midsole from the medial side portion. The leg serves to resist pronation-causing forces, and the horseshoe-shaped plate serves to distribute them about the heel.

However, there are runners, in whom no pronation, or pronation of less than a harmful extent, occurs and who, when running over longer distances experience, to the contrary, an outward pivoting of the foot, known as "supination". Such motion causes the shin to be twisted outward, which also has a harmful effect on the knee joint.

Thus, the primary object of the invention is to improve a midsole for athletic shoes of the type initially mentioned so that harmful supination positions are avoided, and as flat a position of the foot as possible can be attained quickly. At the same time, it is also sought to assure that the runner does not go from a permissible, reduced supination position to an undesirable, harmful pronation position.

This is achieved by the fact that the stabilizing element consists of a U-shaped part, covering the entire heel edge area, and a part which closes the U-shaped part at the middle part of the foot in a manner creating a window into which an island of the full thickness of the midsole engages. The stabilizing element also has a strip which extends along the lateral side of the midsole up to at least, approximately, the little toe area of a shoe provided with such a midsole.

With the invention, in the entire lateral area of the midsole a high positioning force acting in the direction of the flat position of the foot is achieved. At the same time, by the arrangement of the stabilizing element, an overtilting in a medial direction (pivoting of the foot onto the inner heel edge area) with a subsequent harmful pronation, is avoided by holding the pivoting angle of the foot to a minimum.

These and further objects, features and advantages of the present invention will become more obvious from the following description when taken in connection with the accompanying drawings which show, for purposes of illustration only, a single embodiment in accordance with the present invention.

BRIEF DESCRIPTION OF THE DRAWINGS

FIG. 1 is a lateral side elevational view of a midsole according to a preferred embodiment of the invention;

FIG. 2 is a bottom plan view of the midsole according to FIG. 1;

FIG. 3 is a medial side elevational view of the midsole according to FIG. 1, wherein the sole has been inverted so that the bottom of the midsole is on top in this view;

FIG. 4 is a rear elevational view of the midsole according to FIG. 1, the sole being shown turned onto its medial side;

FIG. 5 is a lateral side view of a stabilizing element of the midsole of FIGS. 1–4;

FIG. 6 is a top plan view of the stabilizing element of FIG. 5 with a heel segment broken away to reveal the cross-sectional shape thereof; and FIG. 7 is an inverted medial side view of the stabilizing element according to FIG. 5.

DETAILED DESCRIPTION OF THE PREFERRED EMBODIMENT

A cushioning or shock absorbing midsole 1, preferred for athletic shoes intended especially for medium and long distance running, made of soft elastic material, for example of foamed polyurethane with a Shore hardness of 35 to 50 Shore A, especially of 40 to 45 Shore A, has a recess 2 that is approximately in the shape of the number "nine," in which a ring portion is formed by a horseshoe-shaped part 3 that extends around the heel edge area 4 and a connecting duct area 5, and in which a tail portion 6 extends along the lateral (outer) side 7, approximately into the area 8 of the small toe of a wearer's foot.

In recess 2, a stabilizing element 9, of a shape matched to recess 2, is inserted. Element 9 has a Shore hardness of about 55 to 70 Shore A, especially 60 to 65 Shore A, and is formed, preferably, also of foamed polyurethane. Consequently, stabilizing element 9 also has a U-shaped part 10 covering heel edge area 4, and a bar part 12 that closes the U-shaped part at the middle part of the foot 11, in other words in the vicinity of the arch. Parts 10 and 12 create a window into which an island 14, of the full thickness of the midsole 1, extends.

Corresponding to tail 6 of recess 2, stabilizing element 9 has a strip 15, which extends along the lateral side 7 of the midsole approximately up to little toe area 8. This strip 15, preferably, has a front strip part 16 that is wider and/or thicker than a connecting strip part 17. Advantageously, the thickness of connecting strip part 17 corresponds to about 20 percent to 70 percent, especially 50 percent, of the thickness of front strip part 16.

To stabilize midsole 1, especially to avoid supination to a harmful extent, stabilizing element 9 is about 1.3 to 3 times, especially 1.5 to 2.5 times as thick in lateral heel edge area 4.1 as in medial (inside) heel area 4.2.

Advantageously, top surface 18 of stabilizing element 9, at least in heel edge area 4 and optionally also in front strip part 16, is inclined downwardly toward the inside, i.e., toward the center of the midsole. Preferably, the inward angle of inclination $\alpha$, i.e., in the direction of bar 12 and island 14 (see broken out section of FIG. 6), has a value which increases to about 80°, but less than 90° near the bar 12 and island 14. As a result, especially in the area of island 14, a soft sinking of the heel in the material of midsole 1 and a gradually more intensely acting damping are obtained. Also as a result, a gradual pressure reduction and a more uniform stress of midsole 1 during walking is obtained.

Advantageously, all sections 4, 4.1, 4.2, 12, 16, and 17 of stabilizing element 9, which have differing thicknesses, gradually merge from one to another. As a result, during running, pressure spots are avoided on the sole of the runner.

According to another advantageous aspect of the invention, midsole 1 is provided on the top side, around heel edge area 4, with a heel support 19, which is higher on medial side 20 of midsole 1 than on lateral side 21 of the midsole. As a result, an especially good support of the heel is obtained even for the case in which the wearer's foot very quickly shifts into a flat position from a supinated position. The heel support, on medial side 20, thus reinforces the action of inner stabilizing element section 4.2 in the sense of preventing pronation to a harmful extent.

Bar 12 of stabilizing element 9, which connects U-shaped part 10, in front of the heel bone or up to the middle part of the foot 11, into a closed ring, also increases the tilting moment and thus the lateral stability of entire midsole 1.

The midsole according to the invention thus offers the considerable advantage that a flat position of the foot is achieved as fast as possible, and at the same time assurance is provided that pronation to a harmful extent does not occur as a result of too fast a correction of a supinating motion after pivoting out of the foot.

While I have shown and described various embodiments in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. Midsole for sport shoes, especially for medium and long distance running, of soft elastic material, which has a recess formed on an underside thereof, and a stabilizing element of a material that is harder than the material forming the midsole inserted into said recess; wherein said stabilizing element has a U-shaped part filling said recess in the entirety of a heel edge area, a bar part which extends across the midsole in an area corresponding to a middle part of a wearer's foot in a manner forming a window in which an island of the softly elastic midsole material engages, and a strip part which extends along the lateral side of the midsole up to at least approximately a little toe area; wherein the bar part has a thickness which is about 20 to 70 percent of the thickness of the stabilizing element at a medial portion of the heel edge area.

2. Midsole for sport shoes, especially for medium and long distance running, of soft elastic material, which has a recess formed on an underside thereof, and a stabilizing element of a material that is harder than the material forming the midsole inserted into said recess; wherein said stabilizing element has a U-shaped part filling said recess in the entirety of a heel edge area, a bar part which extends across the midsole in an area corresponding to a middle part of a wearer's foot in a manner forming a window in which an island of the softly elastic midsole material engages, and a strip part which extends along the lateral side of the midsole up to at least approximately a little toe area; wherein said stabilizing element is thicker in a lateral portion of the heel edge area than in a medial portion of the heel edge area.

3. Midsole according to claim 2, wherein said lateral portion is about 1.5 to 2.5 times thicker than said medial portion.

4. Midsole according to claim 3, wherein the bar part has a thickness which is about 20 to 70 percent of the thickness of the stabilizing element at the medial portion of the heel edge area.

5. Midsole according to claim 2, wherein the stabilizing element has a hardness in the range of 55 to 70 Shore A.

6. Midsole according to claim 5, wherein the midsole and stabilizing element are formed of foamed polyurethane.

7. Midsole according to claim 2, wherein the softly elastic midsole material has a Shore hardness in a range of 35 to 50 Shore A.

8. Midsole according to claim 7, wherein the softly elastic midsole material has a hardness of from 40 to 45 Shore A.

9. Midsole according to claim 8, wherein the stabilizing element has a hardness of from 60 to 65 Shore A.

10. Midsole according to claim 2, wherein said strip part has a front portion located in an area of the ball and little toe area of a wearer's foot that is wider than a connecting strip portion thereof that connects the front portion to the U-shaped part.

11. Midsole according to claim 10, wherein the connecting strip portion has a thickness that is about 50 percent of the thickness of the front strip portion.

12. Midsole according to claim 11 wherein all portions and parts of the stabilizing element having differing thicknesses gradually merge into one another.

13. Midsole according to claim 2, wherein at least one of the midsole and stabilizing element is formed of foamed polyurethane.

14. Midsole according to claim 2, wherein the midsole has an upwardly projecting heel support.

15. Midsole according to claim 14, wherein the heel support is higher on the medial side than on the lateral side of the midsole.

16. Midsole for sport shoes, especially for medium and long distance running, of soft elastic material, which has a recess formed on an underside thereof, and a stabilizing element of a material that is harder than the material forming the midsole inserted into said recess; wherein said stabilizing element has a U-shaped part filling said recess in the entirety of a heel edge area, a bar part which extends across the midsole in an area corresponding to a middle part of a wearer's foot in a manner forming a window in which an island of the softly elastic midsole material engages, and a strip part which extends along the lateral side of the midsole up to at least approximately a little toe area; wherein said strip part has a front portion located in an area of the ball and little toe area of a wearer's foot that is wider than a connecting strip portion thereof that connects the front portion to the U-shaped part.

17. Midsole according to claim 16, wherein the connecting strip portion has a thickness that is about 50 percent of the thickness of the front strip portion.

18. Midsole for sport shoes, especially for medium and long distance running, of soft elastic material, which has a recess formed on an underside thereof, and a stabilizing element of a material that is harder than the material forming the midsole inserted into said recess; wherein said stabilizing element has a U-shaped part filling said recess in the entirety of a heel edge area, a bar part which extends across the midsole in an area corresponding to a middle part of a wearer's foot in a manner forming a window in which an island of the softly elastic midsole material engages, and a strip part which extends along the lateral side of the midsole up to at least approximately a little toe area; wherein a top surface of the stabilizing element, at least in a heel area, is inclined downwardly toward the center of the midsole.

19. Midsole according to claim 18, wherein angle of inclination increases in an inward direction and reaches a value of about 80° to 90° near the bar part and island.

* * * * *